US005232247A

United States Patent [19]

Shields

[11] Patent Number: 5,232,247

[45] Date of Patent: Aug. 3, 1993

[54] WRITING ASSISTANCE ASSEMBLY FOR DISABLED PEOPLE

[76] Inventor: James F. Shields, 4721 W. 184th St., Country Club Hills, Ill. 60478

[21] Appl. No.: 843,898

[22] Filed: Feb. 27, 1992

Related U.S. Application Data

[63] Continuation of Ser. No. 600,846, Oct. 22, 1990, abandoned.

[51] Int. Cl.[5] ..... B42D 5/00

[52] U.S. Cl. ..... 281/44; 281/15.1; 281/45; 462/72; 462/900

[58] Field of Search ..... 281/15.1, 44, 45; 283/45, 67; 156/299; 248/444.1, 445, 446, 451, 447.1; 282/29 C, DIG. 2; 462/900, 901, 71, 72

[56] References Cited

U.S. PATENT DOCUMENTS 4,105,224 8/1978 Rodebaugh et al. ..... 281/45 X 4,148,506 4/1979 Lamb ..... 281/45

5,022,170 6/1991 House ..... 281/45 X

*Primary Examiner*—Mark Rosenbaum

*Assistant Examiner*—Peter Dungba Vo

*Attorney, Agent, or Firm*—Potthast & Ring

[57] ABSTRACT

A writing assistance assembly for use by disabled people comprising a planar base with a smooth writing surface. A smooth adhesive layer overlies the smooth writing surface for holding writing paper sheets against lateral sliding movement across the smooth writing surface during the writing on the sheets of paper. A means for restraining the planar base against lateral movement across an underlying supporting surface is also provided. This assembly can also be utilized by a disabled person to place his disabled hand onto the writing assembly and apply weight there upon as therapy without slipping.

17 Claims, 1 Drawing Sheet

Fig. 1
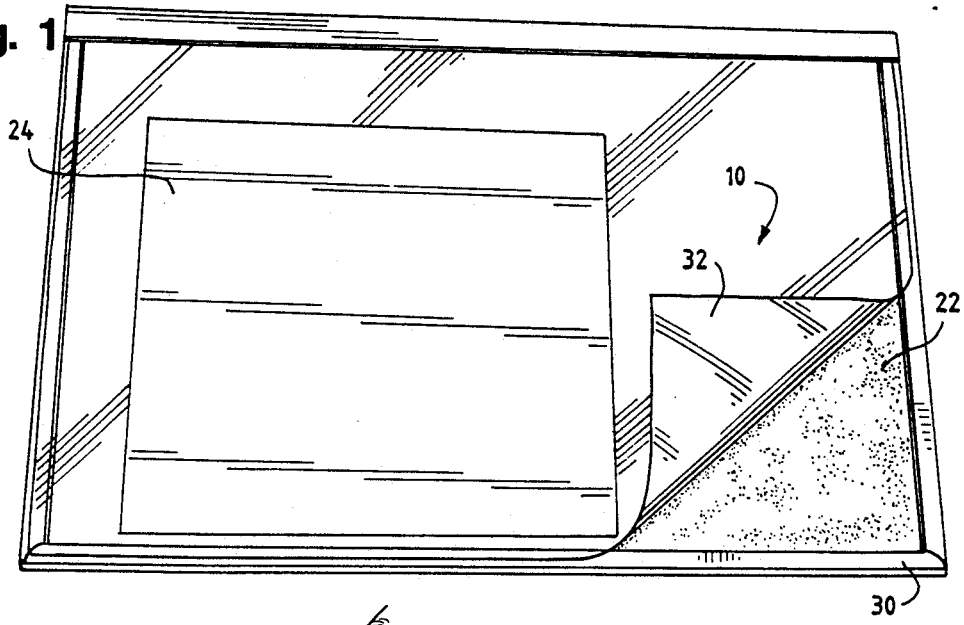
Fig. 2
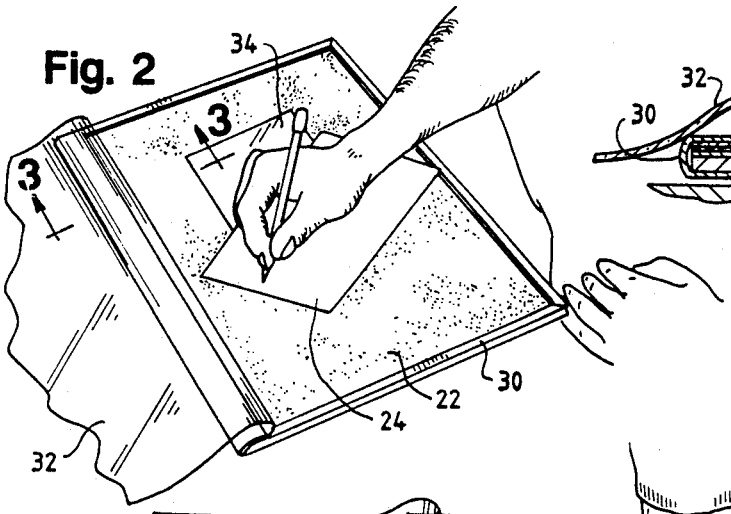
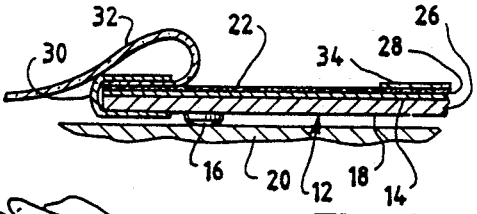
Fig. 3
Fig. 4
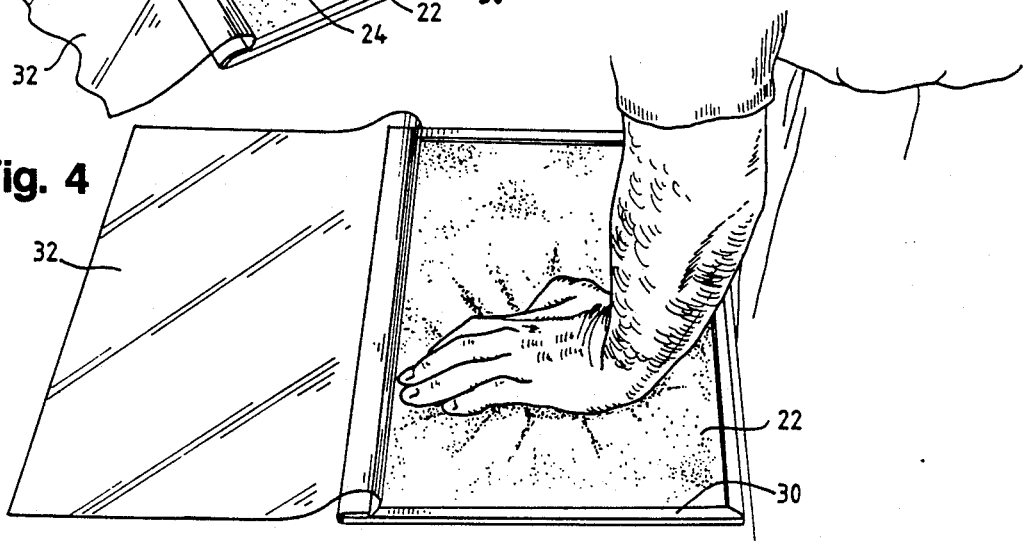

WRITING ASSISTANCE ASSEMBLY FOR DISABLED PEOPLE

This application is a continuation of application Ser. No. 07/600,846, filed Oct. 22, 1990, now abandoned.

BACKGROUND OF THE INVENTION

1. Field of the Invention

The present invention relates to a writing assistance assembly for disabled persons and a method to use the same, and more particularly, writing assistance board which releasable secures writing paper in position for writing and can be used for exercising.

2. Description of the Prior Art

Various assemblies are known to position a sheet or sheets of paper to be viewed or written upon. However, none of these devices releasably secure paper to be written upon by a disabled person who may not have full motor control and will apply forces on a paper which can cause it to slide when writing. In U.S. Pat. No. 4,867,594 issued Sep. 19, 1989, to Poulouin, paper is secured by rings at the top of the sheet and the support base has non-slip tabs. This device does not provide nonslippage of the sheet being written upon since one sheet can slide on top of another or slide on the base when only secured by the rings.

In U.S. Pat. No. 4,162,055 issued Jul. 24, 1979, to Summers, a sheet of paper is secured to the support base at the top of the sheet by a magnet. This device is, for holding sheets to be read and would not prevent slippage of one sheet over another or on the support base when writing.

In U.S. Pat. No. 556,064 issued Mar. 10, 1896, to Pepper, music sheets of paper are supported for reading with rubber strips, pressing the top and bottom portions of the paper to the support. This device does not fully secure a sheet from movement should one write on that sheet. The sheet can slide under the rubber strips or on top of other sheets or the support.

In U.S. Pat. No. 2,914,873 issued Jan. 25, 1957, to Brennan, a bulletin board utilizes a pebbled adhesive to releasably attach papers to display on a bulletin board. This is a pebbled surface and it is a bulletin board, neither are intended to be written upon. Further, means to resist board movement are not provided.

In U.S. Pat. No. 3,848,547 issued Nov. 19, 1974, to Schaefer, a clip-board is provided that secures a sheet or sheets of paper with a clamp to the board at the top of the sheet. This clamp will not fully secure a sheet from slipping relative to the board or another sheet when written upon.

SUMMARY OF THE INVENTION

It is therefore an object of this invention to provide a writing assistance assembly to releasably secure paper on a smooth surface upon which particularly a disabled person, with lack of full motor control of his writing hand and arm, will not move the sheet to be written upon relative to what it is supported upon.

It is a further object to provide a writing assistance assembly for use by disabled people having a planar base with a smooth writing surface with a smooth adhesive layer overlying the smooth writing surface for holding a writing paper sheet against lateral sliding movement across the smooth writing surface during writing on a sheet of paper. Further, means for restraining the planar base against lateral movement across an underlying supporting surface are provided.

It is a further object of this invention to provide a writing assistance assembly which will permit a disabled person to place his disabled hand onto the writing assistance assembly and apply weight onto his hand and arm for therapy, whereby the board assembly will prevent the user from slipping.

It is a further object of this invention to provide a writing assistance assembly for use by disabled people having a planar resilient base with an adhesive writing surface and means for restricting the planar base against lateral movement across an underlying surface in a relatively elevated position to enable flexing of the planar resilient base relative to the underlying surface.

It is a further object of this invention to provide a method of writing with a writing assistance assembly for use by disabled people having a writing surface with an adhesive layer overlying the writing surface for holding writing paper sheets against lateral movement across the smooth writing surface during writing on the sheets of paper. The method comprises the steps of laying a piece of writing paper on the writing surface at a preselected position to be held by the adhesive layer. The method also provides laying a planar shield on the writing surface at another preselected location relative to the sheet of paper to shield the hand of a writer from the adhesive while resting on the writing surface at the other preselected location when writing on the writing paper at the preselected location. The adhesive layer holds as well the shield against lateral movement across the writing surface.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which:

FIG. 1 is a perspective view of the writing assistance assembly;

FIG. 2 is a perspective view of the writing assistance assembly in use;

FIG. 3 is a cross section view of the writing assistance assembly line 3—3 as shown in FIG. 2; and FIG. 4 is a perspective view of the writing assistance assembly in use as a weight therapy device.

DETAILED DESCRIPTION

Referring now to the drawings, writing assistance assembly 10 has a planar base 12 having a smooth writing support surface 14 as seen in FIG. 3. Planar base 12 is conventionally made of a board, or board composite or synthetic board or the like. Base 12 is supported by restraining means or slide resistant feet 16, a plurality of feet 16 are mounted by conventional fasteners or glue to an opposing surface 18 of base 12 opposite the writing support surface 14. Feet 16 are made of a nonskid material which will resist assembly 10 from moving laterally relative to the underlying surface 20 it is resting upon when in use.

A substantially smooth adhesive layer 22 directly overlies the smooth writing surface. This is a conventional contact adhesive which will releaseably secure a writing sheet 24 without damaging it. Adhesive 22 directly contacts entire back surface of sheet 24 and will resist sheet 24 from moving laterally when a person is writing, as seen in FIG. 2.

Planar base 12 has multiple plies as seen in FIG. 3. These plies include a relatively rigid base ply 26 and a relatively flexible ply 28 for carrying adhesive layer 22. These plies can be held together by various conventional means, however, the preferred way is by U-shaped frame 30 fitted around the plies, as seen in FIG. 3. Frame 30 is made of a resilient material to facilitate a clamping action on the plies and can be removed to replace ply 28 carrying adhesive layer 22 when desired.

Writing assistance assembly 10 also provides a movable dust cover 32 which when placed against adhesive layer 22, as seen in FIG. 1, it protects the surface from marring and the adhesive from prematurely degrading from ambient dust. As can be seen in FIG. 1, cover 32 is made of a transparent material such as plastic which facilitates viewing writing paper 24 when cover 32 is in an overlying relationship with adhesive layer 22.

An edge of dust cover 32 is attached to an edge of planar base 12 by U-shaped frame 30 which clamps the edges together. Having an edge of base 12 and cover 32 clamped together permits ease in folding over and removing cover 32 from base 12 and replacing it, as seen in FIGS. 1–4.

When writing assistance assembly 10 is being used to write upon, as seen in FIG. 2, a hand shield 34 is provided to protect the writer's hand from meeting resistance from movement should it come into contact with adhesive layer 22. Generally shield 34 is made of a smooth plastic to allow the writer's hand to slide along its surface while writing. Shield 34 can be placed in any desired position to suit any given writer's posture or writing style.

Another feature of writing assistance assembly 10 can be to provide resilience in planar base 12. As described earlier virtually any board type material will provide some flexibility particularly when base 12 is spanned over slide resistant feet 16. Feet 16, elevate base 12 over underlying support 20 and by spacing feet 16 a part, particularly along the perimeter of base 12, base 12 is supported to slightly flex when force is applied to its surface. This is helpful when a writer is erasing and when a disabled person is placing weight on base 12 as seen in FIG. 4.

Thus, the above described structure provides another utilization of this assembly, a weight therapy device. A disabled person, as seen in FIG. 4, can place his hand on adhesive layer 22 and lean weight onto his arm and hand. Assembly 10 will not slip because of feet 16 and neither will the person's hand because of adhesive layer 22. It becomes a very useful and safe weight therapy device.

U-shaped frame 30 serves to also reduce flexing of planar base 12 when force is applied to the surface. As can be seen, frame 30 is disposed along the entire perimeter of assembly 10.

In utilizing assembly 10, a writing sheet of paper 24 is laid down at a preselected location onto adhesive layer 22. Shield 34 is then laid onto adhesive layer 22 at a desired location in order to keep the writer's hand off of adhesive layer 22 and moving smoothly while writing. The same adhesive layer 22 releasably secures writing sheet 24 and shield 34 in position.

When desired, the writer can easily peel off writing sheet 24 and remove it or move it to another location on adhesive layer 22. Likewise, this can be independently done with shield 34.

Dust cover 32 should be kept in an overlying position over adhesive 22 when assembly 10 is not in use. This will provide longevity to adhesive 22 as mentioned above. When assembly 10 is desired to be used for writing or therapy, cover 32 can easily be moved away from adhesive layer 22 as seen in FIGS. 1–4.

While a detailed description of the preferred embodiment of the invention has been given it should be appreciated that many variations can be made there to without departing from the scope of the invention as set forth in the appended claims

I claim:

1. A writing surface assistance assembly for use by disabled people, comprising:

a planar base having a smooth writing support surface and an opposing surface opposing to the writing support surface;

a smooth adhesive layer directly overlying on and disposed outwardly from the smooth writing support surface for holding writing paper sheets placed directly on top of the smooth adhesive layer against lateral sliding movement across the adhesive layer overlying the smooth writing support surface during writing on the sheets of paper; and means for restraining the planar base against lateral movement across an underlying supporting surface, the restraining means being attached to the opposing surface of said planar base to restrain the writing support surface from lateral movement relative to the underlying supporting surface.

2. The writing assistance assembly of claim 1 includes a flexible movable dust cover for protecting the smooth adhesive layer which overlies the smooth writing support surface when in overlying relationship therewith, and means for attaching an edge of the dust cover to an edge of the planar base to enable folding of the dust cover along said edge and to enable removing said dust cover from overlying relationship with the adhesive layer.

3. The writing assistance assembly of claim 2 in which said dust cover is made of transparent plastic to enable viewing of the writing paper when the dust cover is in overlying relationship therewith.

4. The writing assistance assembly of claim 2 in which said attaching means includes a generally U-shaped frame member which fits over the edge of the planar base for both protecting the edge of the planar base and holding the edge of the dust cover.

5. The writing assistance assembly of claim 1 in which the lateral movement restraining means includes a plurality of slide resistant feet and means for mounting the plurality of slide resistance feet to a surface of the planar base opposite the smooth writing support surface.

6. The writing assistance assembly of claim 1 in which the planar base is resilient, and said lateral movement restraining means includes means for supporting the planar base off the underlying supporting surface to enable resilient flexing thereof when downward force is applied to the writing support surface for purposes of erasure.

7. The writing assistance assembly of claim 1 in combination with a hand shield movably adhered to the adhesive layer adjacent to a writing sheet to interpose between the adhesive layer and a hand of a person when said hand is resting on said hand shield adjacent to the writing sheet during writing.

8. The writing assistance assembly of claim 1 in which said planar base has multiple plies.

9. The writing assistance assembly of claim 8 in which said multiple plies includes a relatively rigid base ply, and a relatively flexible ply overlying the base ply for carrying the adhesive layer.

10. The writing assistance assembly of claim 9 in which said plies are held together at perimeter positions thereof by a U-shaped frame fitted there around.

11. A writing assistance assembly for use by disabled people, comprising:

a planar resilient base having a smooth writing support surface having a smooth adhesive layer directly overlying on and exposed outwardly from the smooth writing support surface for holding a writing paper sheet placed directly on top of the smooth adhesive layer against lateral sliding movement across the adhesive layer overlying the smooth writing support surface during writing on the sheet of paper; and means for restricting the planar base against lateral movement across an underlying surface, the restricting means being attached to said planar resilient base in an elevated position relative to the underlying surface.

12. The writing assistance assembly of claim 11 in which said restraining means includes a plurality of slide resistant feet, and means for mounting said feet to a side of the base opposite said writing support surfaces.

13. The writing assistance assembly claim 12 in which said feet are mounted at perimeter locations to facilitate flexing of the planar resilient base.

14. The writing assistance assembly of claim 11 including a dust cover, and means for mounting the dust cover to the base for movement between one position in which the dust cover protectively overlies the adhesive writing surface, and to another position in which the dust cover is removed from the adhesive writing surface.

15. The writing assistance assembly of claim 14 including a stiffening member at a perimeter location of the planar base to relatively reduce flexibility of the base at said perimeter location.

16. The writing assistance assembly of claim 15 in which said stiffening member includes a frame surrounding the entire perimeter of the base.

17. The writing assistance of claim 11 in which the adhesive writing surface is substantially smooth.

* * * * *